US006515418B1

(12) United States Patent
Geens et al.

(10) Patent No.: US 6,515,418 B1
(45) Date of Patent: Feb. 4, 2003

(54) HIGH PRESSURE SODIUM DISCHARGE LAMP

(75) Inventors: Rudy E. A. Geens, Heusden-Zolder (BE); Carlo J. M. Vlekken, Bertem (BE)

(73) Assignee: Flowil International Lighting (Holding) B.V. (NL)

( * ) Notice: Subject to any disclaimer, the term of this patent is extended or adjusted under 35 U.S.C. 154(b) by 0 days.

(21) Appl. No.: 09/830,944

(22) PCT Filed: Oct. 29, 1999

(86) PCT No.: PCT/EP99/08205

§ 371 (c)(1),
(2), (4) Date: Aug. 22, 2001

(87) PCT Pub. No.: WO00/26940

PCT Pub. Date: May 11, 2000

(30) Foreign Application Priority Data

Nov. 2, 1998 (DE) ..... 198 50 345
Nov. 11, 1998 (DE) ..... 198 51 955

(51) Int. Cl.[7] ..... H01J 61/22; H01J 61/82
(52) U.S. Cl. ..... 313/567; 313/565; 313/550
(58) Field of Search ..... 313/567, 564, 313/565, 550, 571, 639, 642

(56) References Cited

U.S. PATENT DOCUMENTS 4,342,938 A * 8/1982 Strok ..... 313/565
4,567,396 A * 1/1986 McVey ..... 313/25
5,150,017 A * 9/1992 Geens et al. ..... 313/565

FOREIGN PATENT DOCUMENTS

| | | | |
|---|---|---|---|
| EP | 0360326 | * | 3/1990 |
| EP | 0364014 | * | 4/1990 |
| EP | 0680073 | * | 11/1995 |
| FR | 2387510 | * | 11/1978 |

OTHER PUBLICATIONS

Kaufman, "Nonvisual Effects of Radiant Energy", US New York, I.E.S., XP 002036318, pp. 19–1, 19–22 to 19–23.*

* cited by examiner

*Primary Examiner*—Ashok Patel
(74) *Attorney, Agent, or Firm*—Brooks & Kushman P.C.

(57) ABSTRACT

A high pressure sodium vapour lamp having a fill consisting of sodium, mercury and xenon in an arc tube with a sodium weight portion within the sodium-mercury-amalgam of approx. 12% to approx. 20%, having a xenon filling pressure in the cold state between approx. 180 Torr and approx. 350 Torr, having a D-line reversal width (distance of the tops of both wings of the sodium-D-line of the radiation spectrum) of approx. 110 Å to approx. 200 Å, and having approx. 14% to approx. 18% radiation portion in the red wave length range 635 nm to 750 nm and having approx. 7% to approx. 10% radiation portion in the blue wave length range 380 nm to 500 nm, in each case of the radiation power in the wave length range 380 nm to 780 nm for promotion of plant growth is provided.

3 Claims, 4 Drawing Sheets

HIGH PRESSURE SODIUM DISCHARGE LAMP

Figure 1:
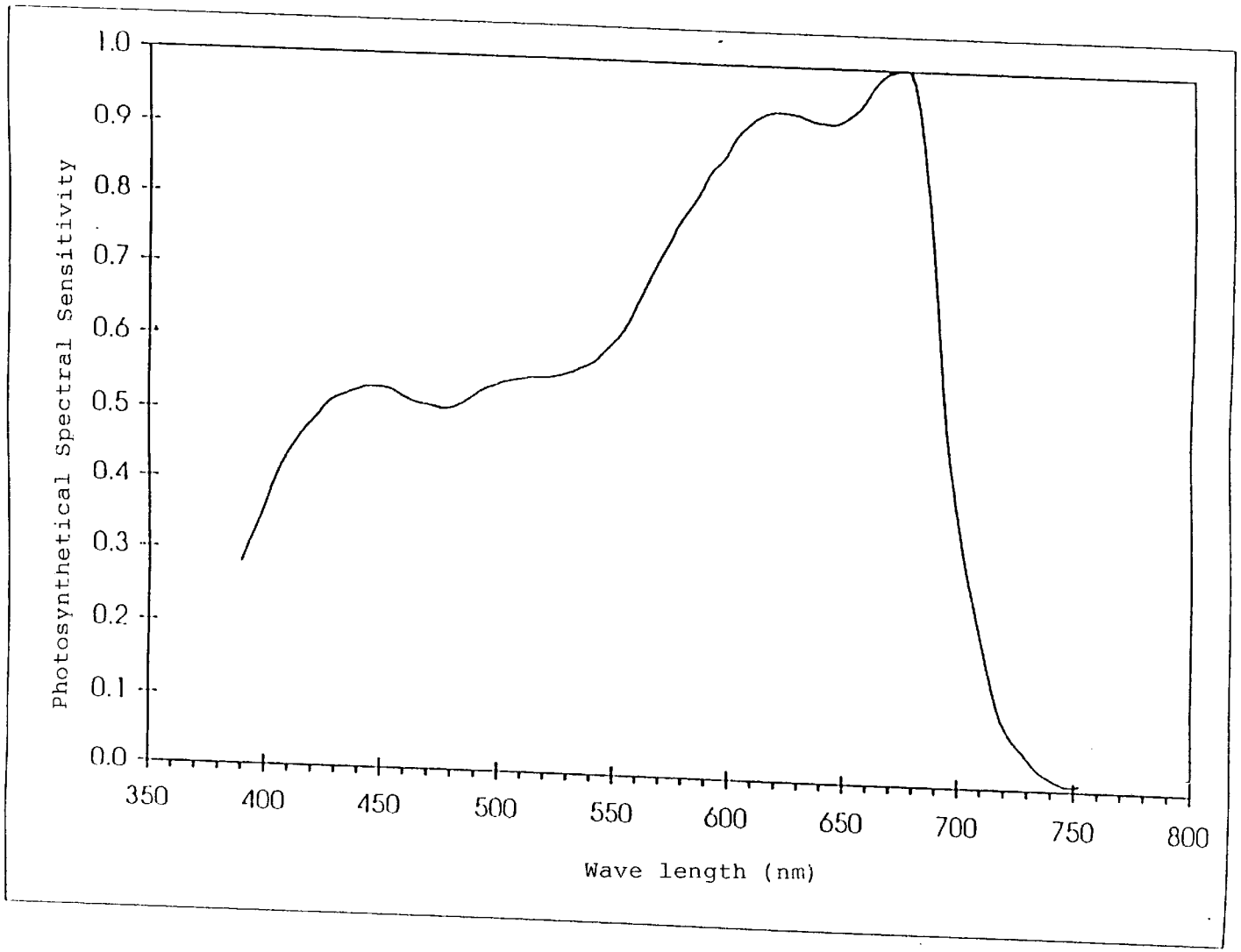

The invention concerns a high pressure sodium vapour lamp with an arc tube made from polychrystalline aluminumoxyd (PCA), a fill of sodium and mercury, as well as xenon as a fill gas.

High pressure sodium vapour lamps of this type are known for their high luminous efficiency in the range of the visible spectrum. This is so because the light emission of these lamps takes place in a spectral area which corresponds to the maximum of the graph of eye sensitivity. The most commercially available high pressure sodium vapour-(HPS)-lamps are, therefore, optimized with regard to maximum lamp lumens.

In addition thereto HPS-lamps enjoy a long life and a very small lumen depreciation.

The high luminous efficiency and the long life also render HPS-lamps particularly useful for application in plant growth promotion, despite the fact that their spectrum is optimized for the human eye and not for the favourisation or promotion, respectively, of the plant growth process.

From EP 0 364 014) a method is known to optimize the blue part of the spectrum of a HPS-lamp. It is known that this is important to prevent plants from growing spindle-meagre and with small leaves. The situation in green houses, however, is such that there is a sufficient amount of blue light of the sun present already, even if it is cloudy in wintertime.

The European patent application mentioned describes a HPS-lamp which is optimized with regard to photosynthesis in plants, discloses an optimum sodium-mercury-amalgam-proportion and points out that the PCA arc tube must be made shorter and wider in order to make this lamp electrically compatible with present ballasts. It has been discovered, however, that when trying to follow this way the arc tube becomes short to an extent that increased heat losses at the arc tube ends become apparent and that, hence, the gain of efficiency with regard to photosynthesis gets lost. In addition thereto the low length of the arc tube can result in undesired changes of light distribution in some in the luminaires destined for plant growth. This implies that the known lamp as described is usable in connection with specially devised operating systems only.

The object underlying the invention is seen in provision of a high pressure sodium vapour lamp of the type mentioned above which is optimized with regard to the efficiency of photosynthesis in plants, which is exchangeable with the present lamps, which is compatible with present ballasts, starters and luminaries, and which finally when compared with a conventional HPS-lamp renders a gain as to photosynthetic effect.

This object is met in accordance with the invention by a high pressure sodium vapour lamp having a PCA-arc tube, a fill consisting of sodium, mercury and xenon as a filling gas, with a sodium weight portion within the sodium-mercury-amalgam of approx. 12% to approx. 20% and a xenon filling pressure in the cold state between approx. 180 Torr and approx. 350 Torr, with a D-line reversal width of the radiation spectrum of approx. 130 Å to approx. 200 Å, and with approx. 14% to approx. 18% radiation portion in the red wave length area 635 nm to 760 nm and with approx. 7% to approx. 10% radiation portion in the blue wave length area 380 nm to 500 nm, each of a radiation power within the total wave length area 380 nm to 760 nm.

To minimize the heat losses towards the walls of the arc tube it has been recognized as effective to fill the tube with a xenon pressure which is as high as possible without endangering the flawless ignition of the lamps by means of the starters which are certified therefore. This leads to an increase of luminous efficiency of approx. 10%. With a lamp in accordance with the invention the xenon pressure should be brought to a value which is as high as possible but at the same time permits the lamps to get perfectly ignited by the starters which are certified for the respective lamp type. In praxi these are superposed pulse igniters usually which show a minimum peak voltage specified in dependency of lamp power.

In addition thereto the discharge length of the lamp according to the invention should not deviate by more than 25% from the discharge length of conventional HPS-lamps of the same power. If one conforms to this, then optical compatibility with present luminaires is secured. The wall loading (lamp power divided by the wall surface of the arc tube between the electrodes) with conventional HPS-lamps is optimized. Notwithstanding that with higher loading the radiated power increases the wall loading must be kept beneath a certain value to secure a long life. This value usually corresponds to a maximum arc tube temperature of 1200° and lies between 15 and 25 W/cm$^2$ in dependency of nominal lamp power. With the lamp in accordance with the present invention the wall loading may deviate 10% maximally from the value of the corresponding conventional HPS-lamp. The intended increase of photosynthesis efficiency is then realized by optimizing the composition of the sodium-mercury-amalgam and the D-line reversal width (distance of the tops of the two wings of the sodium-D-line of the radiation spectrum) of approx. 130 Å to approx. 200 Å. These variables are elected so that photosynthesis efficiency of the lamp is optimized. The photosynthesis efficiency or efficacy ,respectively, is defined as $$\eta_{ps}=\Phi_{ps}/P_{la}$$

wherein $\Phi_{ps}=K\int V_{ps}(\lambda)P_\lambda\delta\lambda$ is the photosynthetical effective radiation portion expressed in phytolumen, and $P_{la}$ is the power distributed within the lamp.

$K=1088.4$ Phyto-lm·W$^{-1}$ $V_{PS}$ is the spectrally effective function for the photosynthesis in plants indicated in FIG. 1 and $P_\lambda$ is the lamp spectrum.

Comparison with lamp efficiency is carried out. Lamp efficiency is defined as $$\eta=\Phi/P_{la},$$

wherein $\Phi K_m\int V_x\ P_\lambda\delta\lambda$ is the luminous flux expressed in lumen and $K_m=683$ lm·W$^{-1}$, and $V_\lambda$the degree of spectral sensitivity according to DIN 5031, part 2.

Figure 2:
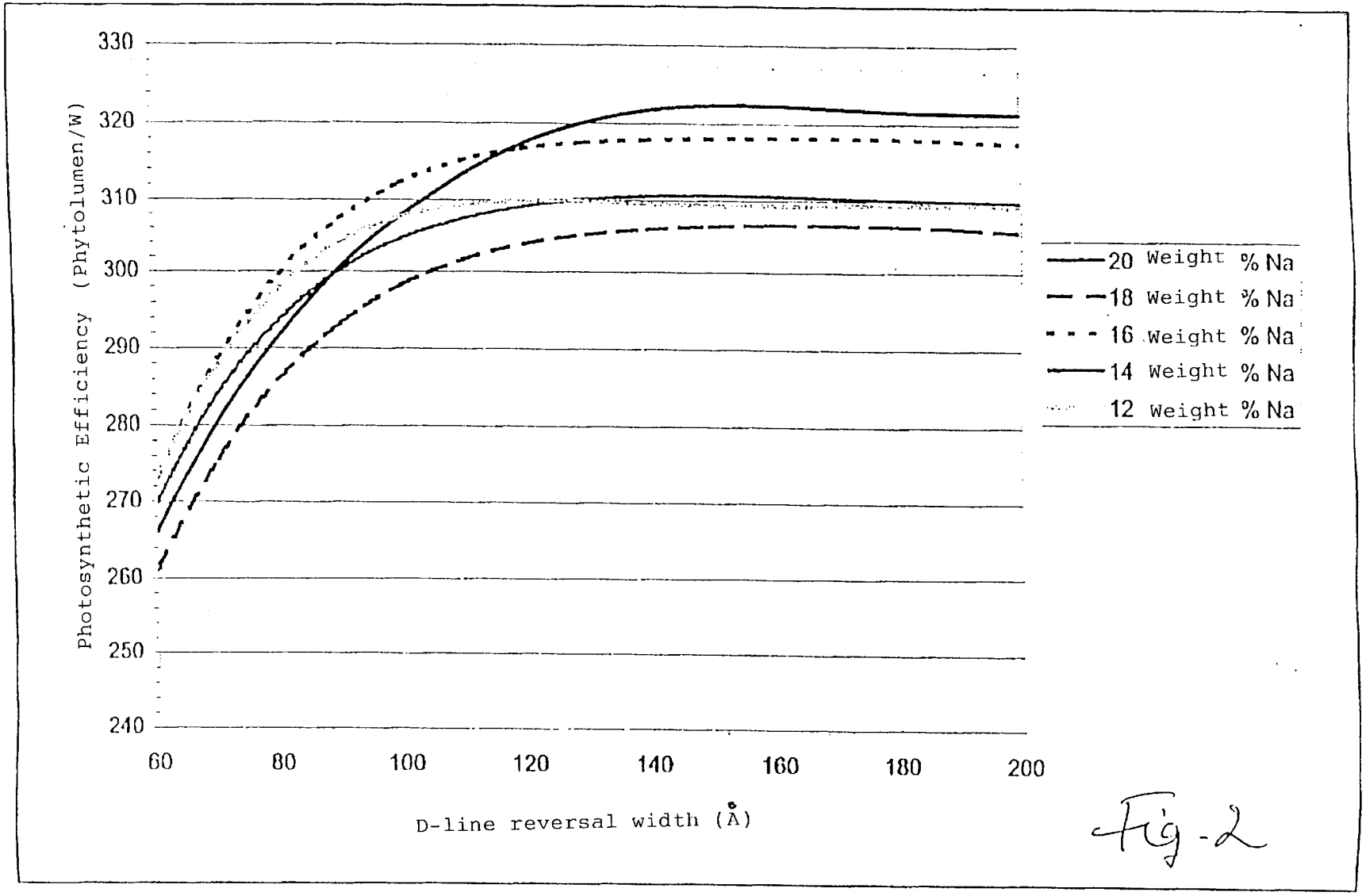
Figure 3:
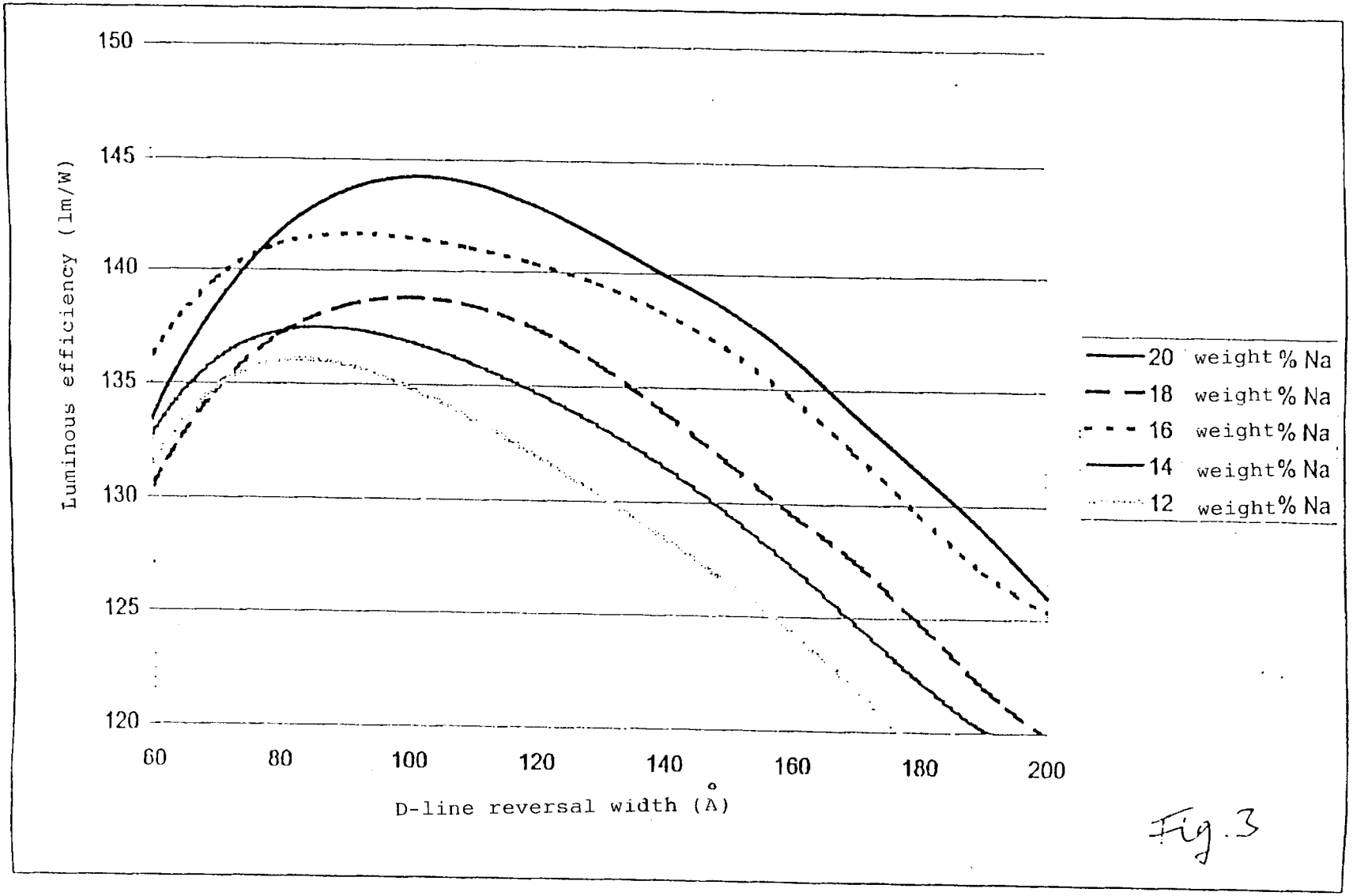
Figure 4:
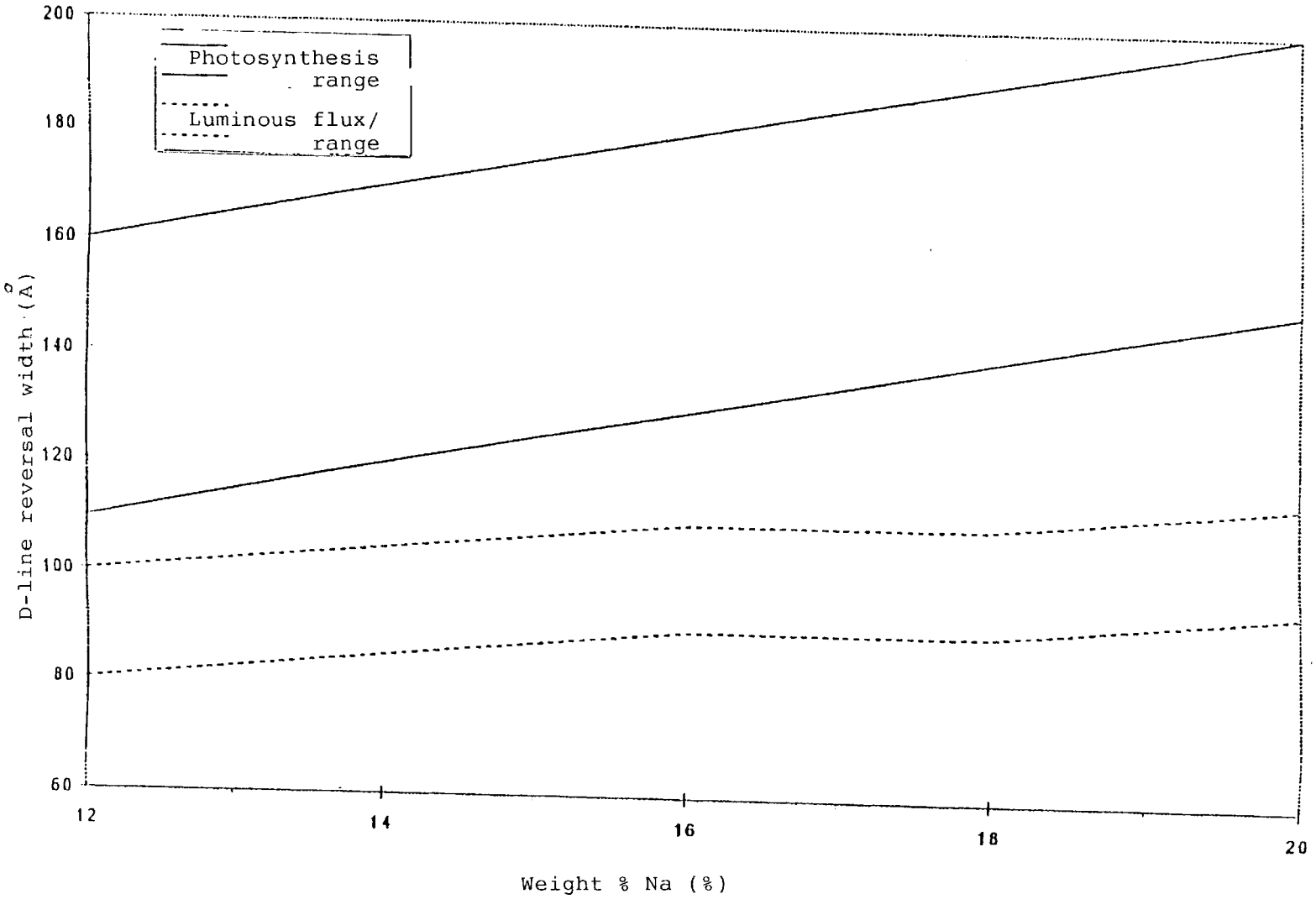

In the drawing is:

FIG. 1 the photosynthetical spectral sensitivity in dependency of wave length;

FIG. 2 the photosynthetical efficiency of the sodium high pressure lamp in dependency of D-line reversal width;

FIG. 3 the luminous efficiency of the sodium-D-high pressure lamp in dependency of D-line reversal width;

FIG. 4 the gradient of the range which is optimal for photosynthesis and general lighting applications with a sodium high pressure lamp having 12 to 20% of weight sodium in the amalgam in dependency of the D-line reversal width.

The dependency of photosynthetical efficiency of the amalgam composition and the said D-line reversal width in the case of a 400 W-lamp has been tested, as shown in FIG. 2. The data given in FIG. 2 have been obtained by the manufacture of lamps having different amalgam compositions and by measuring their photosynthetically effective radiation portions as functions of the D-line reversal width. The data have been recorded during the starting phase of the lamps by means of a reference ballast. From FIG. 2 it can be easily derived that for all the amalgam compositions there is a very clear relation between D-line reversal width and photosynthesis efficiency.

FIG. 2 shows that the photosynthesis efficiency (phytolumen per Watt) in dependency of the sodium weight in the amalgam reaches a maximum at values between 130 and 200 Å of the D-line reversal width. Thereby with increasing sodium content the maximum shifts to higher values of the D-line reversal width. For each composition of the sodium amalgam a range for maximum efficiency of photosynthesis can be recognized from FIG. 2.

In FIG. 3 luminous efficiency (in lumen per Watt) is graphed for different sodium weights as function of the D-line reversal width. For each sodium portion a maximum of luminous efficiency can be recognized there, which, however, shows a lower dependency of the sodium portion as compared with photosynthesis efficiency.

The measuring data are composed in table 1 and in FIG. 4 below. The table contains the numerical values of the photosynthesis efficiency and of the luminous efficiency in dependency of the sodium weight portion in the amalgam. In FIG. 4 these values are depicted graphically.

From FIG. 4 it can be clearly recognized that for the same sodium content of 12 to 20% the range of maximal efficiency of photosynthesis as compared with luminous efficiency is characterized by higher D-line reversal widths.

The desired D-line reversal width in praxi can be reached by increasing the cold spot temperature of the arc tube, whether by varying the distance of the electrode peak from the face of the tube or by application of heat build up bands at the outer surface of both tube ends. With unchanged tube dimensions the operating voltage of the lamp is increased thereby. Attention must be paid with regard to the fact that the lamp operating voltage is low enough to ensure a sufficient life of the lamp. Should the value of the lamp operating voltage be too high, a correction onto the desired value can be reached, also with constant D-line reversal width, by increasing the length of the discharge arc and reducing the diameter of the tube such that the wall loading of the arc tube per $cm^2$ remains constant. It must be observed that, as mentioned above, the arc length is not changed by more than 25%.

TABLE 1

| % Na | Photosynthetis Efficiency (Phytolumen/W) | Luminuous Efficiency (lm/W) |
|---|---|---|
| 12 | 110–160 | 80–100 |
| 14 | 120–170 | 85–105 |
| 16 | 130–180 | 90–110 |
| 18 | 140–190 | 90–110 |
| 20 | 150–200 | 95–115 |

An example has been carried out for the case of a 400 W-amp.

Thereby the arc tube had the following dimensions:

inner tube length: 107 mm inner diameter of the arc tube: 8.1 mm

Arc length: 84.6 mm

Wall thickness: 0.75 mm

The amalgam composition showed 16 percent of weight sodium. The cold xenon pressure within the arc tube was 308 Torr. The cold spot temperature was set to 120 V by adjustment of the distance between electrode point and the face of the arc tube to a value of 17.0 mm.

In the following table 2 the measured characteristics of this lamp are compared with those of a conventional HPS-lamp with increased filling pressure. By the term "conventional" is meant a commercially available sodium high pressure lamp for general lighting applications. Such a lamp corresponds to SYLVANIA Type SHP-TS 400W.

TABLE 2

Comparison lamp example according to the invention-inventional HPS-lamp with increased filling pressure

| | Lamp example | Conventional high pressure sodium lamp |
|---|---|---|
| D-line reversal width (Å) | 130 | 109 |
| Operating voltage (V) | 120 | 98 |
| Lamp power(W) | 424 | 392 |
| Luminous efficiency (lm) | 58028 | 53473 |
| Phytolumen (lm) | 128729 | 115648 |
| PAR (μmol/s) | 715 | 644 |
| Pblue (W) | 11,4 | 9,6 |
| Pred (W) | 17,3 | 14,5 |

The lamp according to the invention described above as an example was tested in praxi. In doing so four varieties of cucumber in a room sealed against daylight have been irradiated and brought up with lamps corresponding to the example given above. The duration of irradiation has been sixteen hours per day and the duration of growth one month. For comparison the same cucumber varieties have been brought up under the same conditions by an irradiation stemming from conventional HPS-lamps as mentioned above already, namely of the type SYLVANIA SHP-TS 400W. The greater lumen output of the lamps according to the invention was compensated by enlargement of the distance between the lamps and the plants in order to obtain the same photosynthetically effective radiation intensity at the level of plant growth or at the substrate, respectively, as in the case of the conventional lamps.

In the following table 3 the test results are listed which have been obtained by the said bringing up of the cucumber plants. From table 3 it will be apparent that the irradiation achieved with the lamps in accordance with the invention significantly promotes the growth of the cucumber plants as can be derived from the obtained plant dimensions, plant weights and leaf sizes detected.

TABLE 3

| | Lamp according to invention | | | | Conventional HPS-lamp | | | |
|---|---|---|---|---|---|---|---|---|
| Cucumber variety | Length cm | Number of leaves | Leaf size cm | weight g | length cm | Number of leaves | Leaf size cm | weight g |
| Sabrina | 128 | 11.6 | 21.6/28.7 | 140.3 | 116.4 | 10.6 | 20.1/26 | 112.6 |
| Dugan | 133.7 | 12.1 | 21.5/27.2 | 143 | 113.2 | 10.8 | 19.3/24.1 | 105.4 |
| Korinda | 121 | 11.9 | 21.8/28.2 | 139.9 | 106.7 | 10.7 | 19.5/24.4 | 104.1 |
| Bellissima | 123.9 | 11.4 | 21.3/27 | 139.4 | 104.7 | 10 | 18.7/23.1 | 101.1 |

Of each of the four cucumber varieties mentioned eighteen specimens respectively have been irradiated by the lamps according to the invention and twenty-two specimens by the conventional lamps.

It will be understood that the indications of the number of leaves and of the weights which deviate from full numbers which, hence, represent decimal fractions, have been produced by forming averages. The average weights have been obtained without roots at the end of the month of growth each. At this early point in time a formation of cucumbers cannot be expected.

What is claimed is:

1. High pressure sodium vapour lamp having a fill consisting of sodium, mercury and xenon in an arc tube with a sodium weight portion within the sodium-mercury-amalgam of approx. 12% to approx. 20%, having a xenon filling pressure in the cold state between approx. 180 Torr and approx. 350 Torr, having a D-line reversal width (distance of the tops of both wings of the sodium-D-line of the radiation spectrum) of between approx. 100 Å and approx. 200 Å, and having between approx. 14% and approx. 18% radiation portion in the red wave lengths range 635 nm to 750 nm and having between approx. 7% and approx. 10% radiation portion in the blue wave lengths range 380 nm to 500 nm, in each case of the radiation power in the wave length range 380 nm to 780 nm for promotion of plant growth.

2. High pressure sodium vapour lamp according to claim 1, characterized in that the sodium weight portion in the amalgam is between 14% and 18% and the D-line reversal width is between 120 Å and 190 Å.

3. High pressure sodium vapour lamp according to claim 2, characterized in that the sodium weight portion in the amalgam is 16% and the D-line reversal width is between 130 Å and 180 Å.

* * * * *